US011047609B2

(12) United States Patent
Maier

(10) Patent No.: US 11,047,609 B2
(45) Date of Patent: Jun. 29, 2021

(54) FREEZER INSERT

(71) Applicant: Donald Maier, Sarasota, FL (US)

(72) Inventor: Donald Maier, Sarasota, FL (US)

( * ) Notice: Subject to any disclaimer, the term of this patent is extended or adjusted under 35 U.S.C. 154(b) by 0 days.

(21) Appl. No.: 16/929,934

(22) Filed: Jul. 15, 2020

(65) Prior Publication Data

US 2021/0018251 A1 Jan. 21, 2021

Related U.S. Application Data

(60) Provisional application No. 62/876,056, filed on Jul. 19, 2019.

(51) Int. Cl.

| | |
|---|---|
| ***F25D 3/00*** | (2006.01) |
| ***B65D 81/38*** | (2006.01) |
| ***F25D 19/00*** | (2006.01) |
| ***F28F 17/00*** | (2006.01) |

(52) U.S. Cl.

CPC ..... *F25D 19/006* (2013.01); *B65D 81/382* (2013.01); *B65D 81/3818* (2013.01); *F25D 3/00* (2013.01); *F25D 19/003* (2013.01); *F28F 17/00* (2013.01); *F25D 2303/0831* (2013.01); *F25D 2331/804* (2013.01)

(58) Field of Classification Search

CPC .... F25D 19/006; F25D 19/003; F25D 11/006; F25D 3/00; F25D 3/005; F25D 2303/08; F25D 2303/0831; F25D 2303/0832; F25D 2331/804; F25D 2303/083; F25D 2303/08222; B65D 81/382; B65D 81/3818

See application file for complete search history.

(56) References Cited

U.S. PATENT DOCUMENTS

| | | | | |
|---|---|---|---|---|
| 5,924,304 | A * | 7/1999 | Sanchez | B65D 81/3883 62/457.4 |
| 2009/0178434 | A1* | 7/2009 | DeMirjian | A47G 19/027 62/457.2 |
| 2014/0013789 | A1* | 1/2014 | Conrad | A45C 15/00 62/331 |
| 2016/0341464 | A1* | 11/2016 | Bagwell, Sr. | B65D 81/3895 |
| 2017/0363341 | A1* | 12/2017 | Nguyen | F25D 3/08 |

* cited by examiner

*Primary Examiner* — Cassey D Bauer
(74) *Attorney, Agent, or Firm* — Steve O'Donnell

(57) ABSTRACT

A chest insert for a freezer is disclosed. The chest insert is placed inside a freezer and food is placed inside the chest insert. Several sides of the chest insert comprise a gap which is partially filled with a refrigerant gel. These gaps are slanted such that the gel can expand into a wider gap as it expands while freezing, lessening the risk of uneven freezing causing the refrigerant gel to press against the walls of the chest insert. The use of the disclosed subject matter reduces freezer burn by stabilizing humidity. Further, the chest insert maintains the temperature inside the chest insert for extended periods if the freezer fails or the power to the freezer is interrupted.

2 Claims, 5 Drawing Sheets

FREEZER INSERT

FIELD OF THE INVENTION

The subject matter of this application pertains to devices and methods to stabilize the temperature in a freezer. More precisely, the subject matter of this application pertains to devices and methods to provide a space within a freezer that is resistant to temperature change. Further, the subject matter of this application pertains to devices and methods to reduce or eliminate freezer burn in frost-free freezers. The subject matter of this application also pertains to devices and methods which mitigate the rate of temperature change in a freezer during a power outage.

BACKGROUND

When the vapor pressure of ice on the surface of a piece of frozen food is greater than the vapor pressure of water in the surrounding air the ice sublimates. This sublimation causes the drying of the surface of the frozen food commonly known as freezer burn. Although some degree of freezer burn can happen at extremely stable temperatures, the problem is most noticeable when the air inside a freezer warms. Such warming can occur from holding the freezer door open when looking for a hidden pint of ice cream or while standing in front of an open door trying to decide what to make for dinner, although the greatest cause of freezer burn comes from frost-free freezers.

A "frost-free" freezer is not the most accurate term. Frost forms in all freezers as moisture in the air contacts sufficiently cold surfaces inside the freezer. Frost-free freezers, also called automatic defrost-freezers, periodically warm to allow frost buildup on the refrigeration coils to melt. The melted ice drains into a drip pan and evaporates. In manual defrost-freezers, the gradual accumulation of ice increases the water vapor pressure in the freezer, which effectively decreases the driving force of sublimation from the surface of the food. In frost-free freezers, ice is not allowed to build up so the water vapor pressure in the freezer is low, which increases sublimation from the food surface. Further, the warming cycles of a frost-free freezer can cause ice on the surface of the food to melt which will then only sublimate faster when the freezer cools again.

Since the rate of sublimation depends on the water vapor pressure inside the freezer, simply placing an open container of water inside the freezer can decrease or slow the progression of freezer burn. Some frozen foods have a protective external layer of ice (know as glaze) that will sublimate before water inside the food does. However, the most common technique of mitigating freezer burn is wrapping foods to maintain a local high water vapor pressure. An uncovered steak on a plate will become freezer burned within a few frost-free cycles, but a similar steak wrapped in freezer paper, and then placed in a plastic freezer bag may sit for several months without noticeable freezer burn.

Although not dangerous, freezer burn affects the taste and texture of food. Depending on the food, the freezer burned section may be able to be cut or scrapped away before eating, but other foods are probably best thrown out when freezer burned.

Temperature cycling by frost-free freezers is bad enough, but at least the temperature drops again before the food spoils. During power outages, the temperature inside the freezer will eventually equilibrate with the ambient temperature if power is not turned back on. The rate of temperature change depends on several factors, but the three largest are likely how full the freezer is, the ambient temperature itself, and the conductivity of the freezer.

A freezer with thick, insulated walls sitting in a basement where the temperature is naturally between 10 and 15° C. will obviously maintain its internal temperature during a power outage longer than a poorly insulated freezer in a 35° C. garage.

The fullness of a freezer also helps maintain the temperature of a freezer during a power outage in part because of the enthalpy of fusion. Water freezes at 0° C. but doesn't immediately melt when the temperature moves above that point. A certain amount of energy is absorbed by a material before the material starts to warm and melt. Other than that, even non-frozen, but chilled, materials mitigate the temperature change inside a freezer because of their specific heat index, which is how much heat is required to raise the temperature of a substance. The greater that mass, the more energy is required to raise the temperature.

SUMMARY

The subject matter of this application is related to devices and methods that resist temperature change inside a freezer.

One embodiment of the subject matter of this application is a chest which fits inside a freezer. The chest is double-walled and has an inner space which is used to store frozen items. There is a space between the inner and outer walls containing an insulating material such as a freezer gel that either doesn't solidify at the temperatures reached by the freezer or freezes below the freezing point of water.

The local humidity inside the chest is stabilized simply by being closed. The insulating material is optimally chilled below the freezing point of water so temperature fluctuations during a defrost cycle are buffered by the insulating material and don't affect the inner space of the chest. Further, in the event of a power outage, the insulating gel inside such a chest is will helps absorb heat outside the chest and keep the entire freezer colder for a longer period.

DETAILED DESCRIPTION

The following description and drawings referenced therein illustrate embodiments of the application's subject matter. They are not intended to limit the scope. Those familiar with the relevant arts will recognize that other embodiments of the disclosed method are possible. All such alternative embodiments should be considered within the scope of the application's disclosure.

Each reference number consists of three digits. The first digit corresponds to the figure number in which that reference number is first shown. Reference numbers are not necessarily discussed in the order of their appearance in the figures.

A chest is comprised of an inner surface and an outer surface. At least part of the chest further comprises a cavity between the inner surface and the outer surface. Said space is partially filled with a refrigerant gel.

Figure 7:
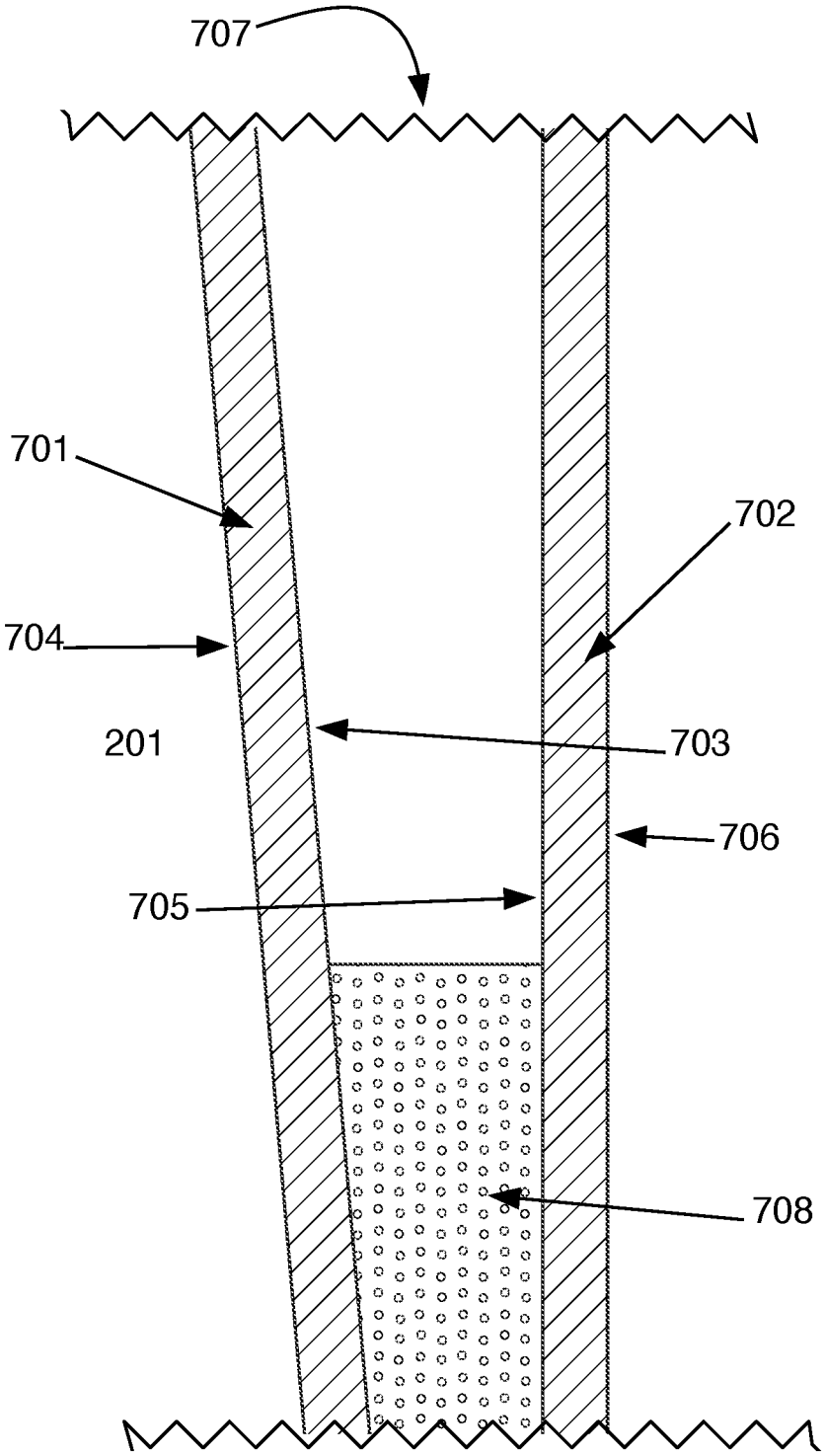
FIG. 7 depicts a segment of an exemplary face showing the walls, gap, and contained freezer gel.

More specifically, in a most highly preferred embodiment, a chest is comprised of an inner compartment (201) and six faces: a top (101), a bottom (102), a first side (103), a second side (104), a back (105) and a front (106). At least one face is comprised of an inner wall (701) and an outer wall (702). In most preferred embodiments, the top, bottom, first side, second side, and back are all comprised of an inner wall and an outer wall. For the sake of clarity, a single such face is described and detailed in FIG. 7.

The exemplary face is comprised of an inner wall (701) and an outer wall (702). The inner wall further comprises an inner surface (703) and an outer surface (704). The outer wall also further comprises an inner surface (705) and an outer surface (706). The face further comprises a cavity (707) between the outer surface of the inner wall and the inner surface of the outer wall. Said cavity containing a refrigerant gel (708). Optimally said cavity is predominantly filled with such gel, although weight and other concerns may need to be taken into account. In most preferred embodiments a cavity is at least 50% filled with the refrigerant gel.

In most preferred embodiments each cavity within a face is in communication with at least one cavity within another face and refrigerant gel may move to expand from one cavity to another.

Each said face is comprised of a material having a thermal insulation value. In those faces comprised of two walls, the inner wall comprises a first R-value (the thickness of the wall in meters divided by the thermal conductivity in Watts per meter Kelvin) and the outer wall comprises a second R-value. For any face, the R-value may be greater than, less than, or equal to, the second R-value, depending on the intended use of the chest. For example, if the chest is stored within a freezer and is primarily intended to preserve the contents of the chest in response to a thermal cycling event or a power outage the R-value of the inner wall may be less than the R-value of the outer wall. If the chest is stored within a freezer and is primarily intended to keep the entire freezer colder for longer during a power outage, the R-values of the inner and outer walls may be approximately equal. An inner wall may be a different material than the corresponding outer wall however due to manufacturing concerns, most embodiments of the subject matter of this application are constructed primarily from a single material, accordingly, if one wants different R-values for internal and external walls the relative thickness of the walls can be adjusted. In most preferred embodiments the chest is constructed primarily of a single material and all walls are approximately the same thickness.

Figure 1:
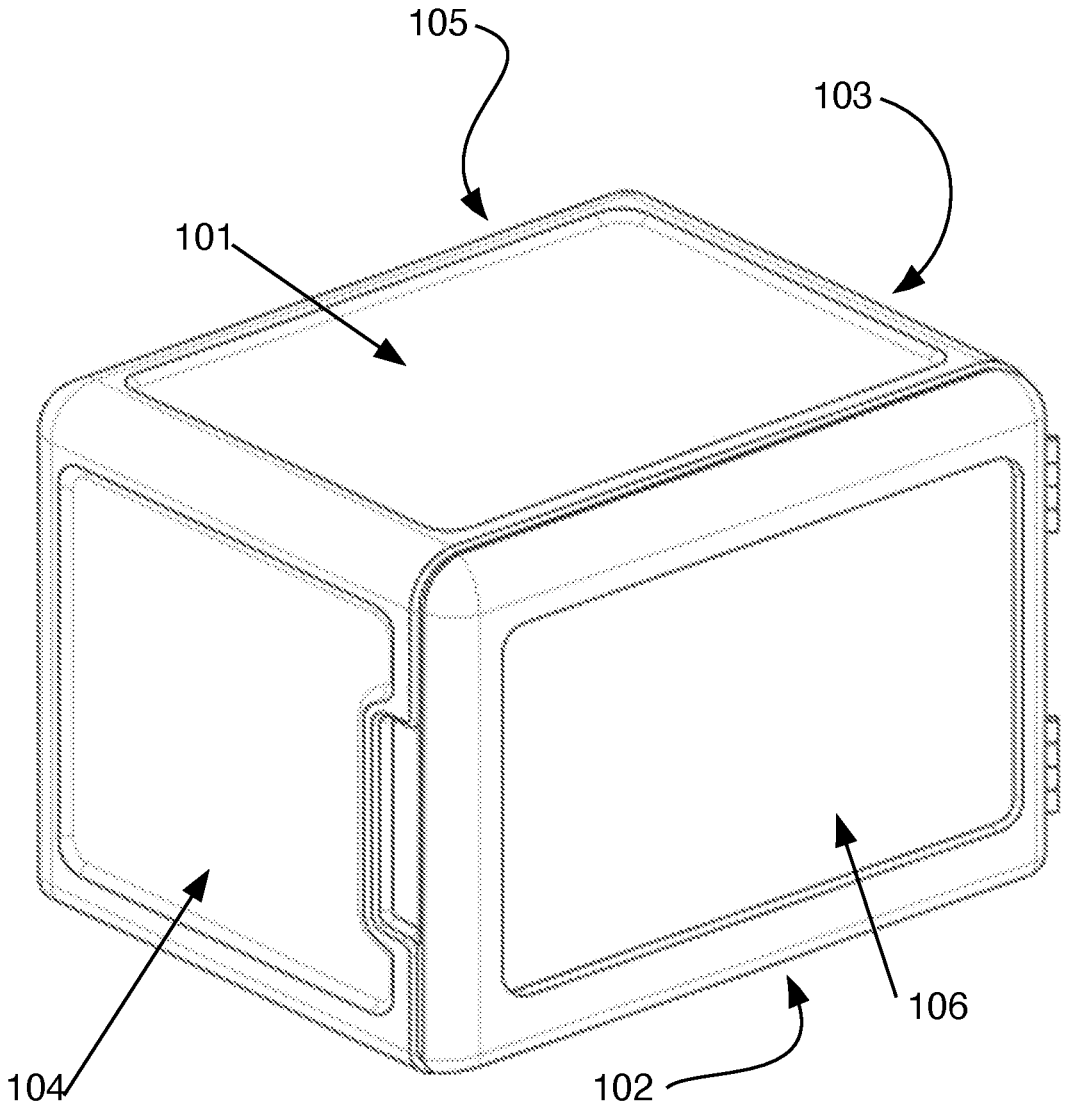
FIG. 1 is a perspective view of the closed chest.
Figure 2:
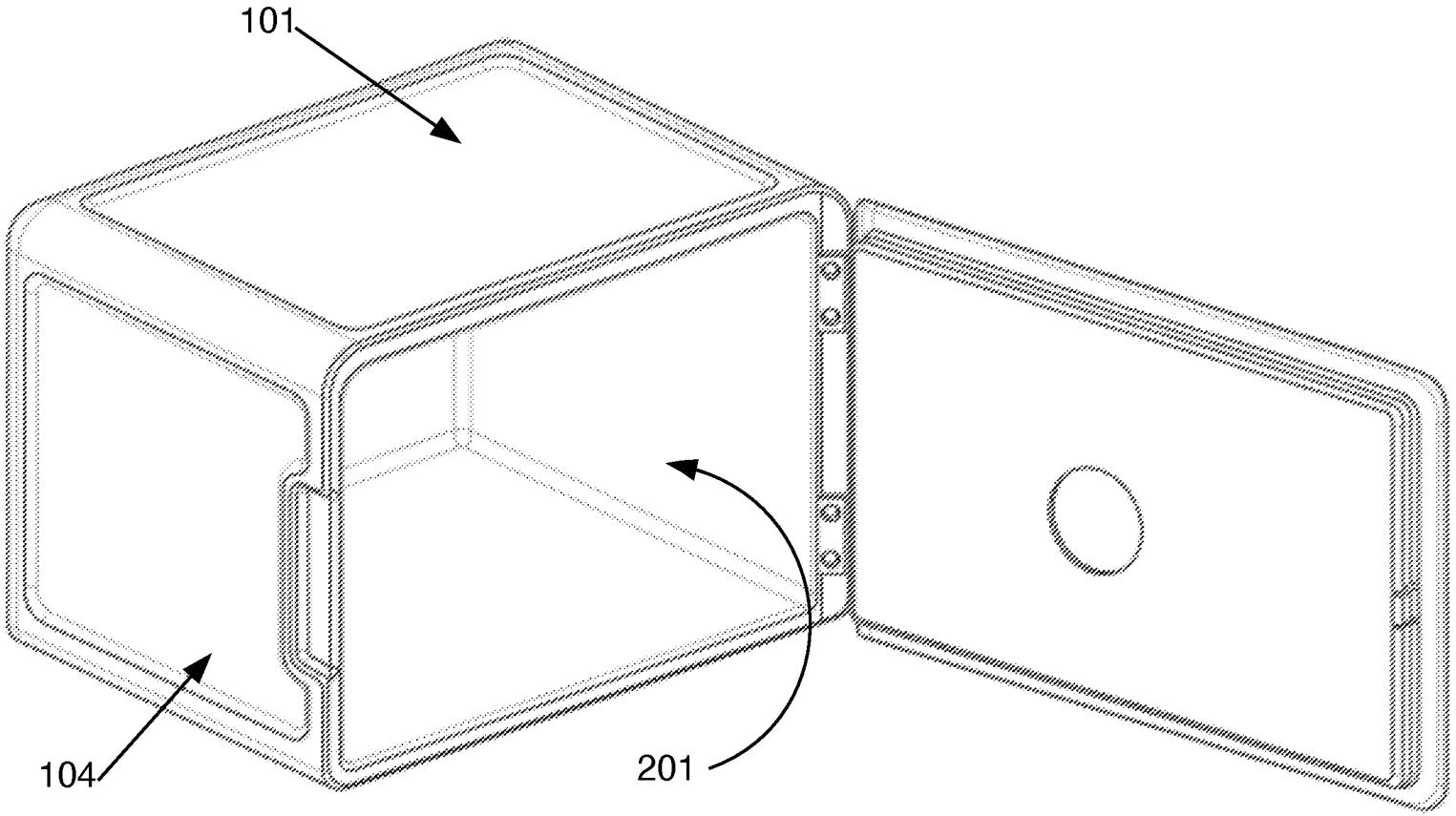
FIG. 2 is a perspective view of the open chest.
Figure 3:
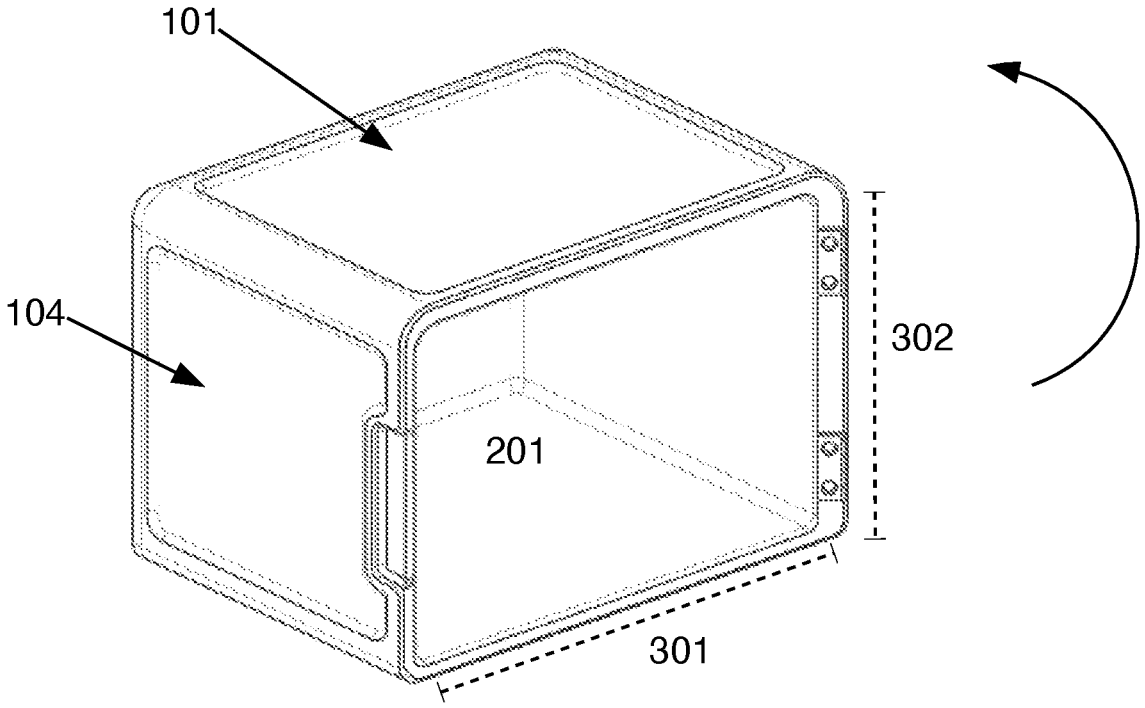
FIG. 3 is a front elevation of the chest with the door removed.
Figure 4:
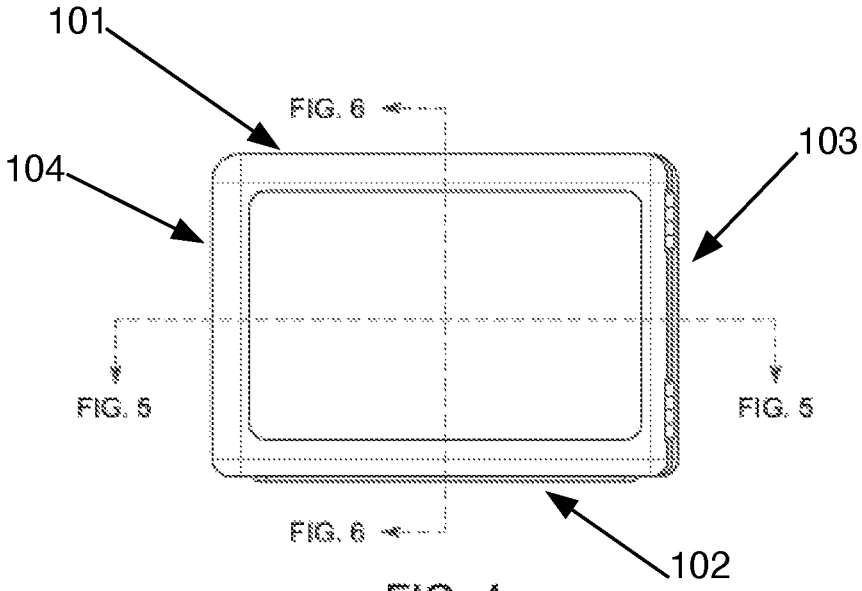
FIG. 4 is a front elevation view of the closed chest
Figure 5:
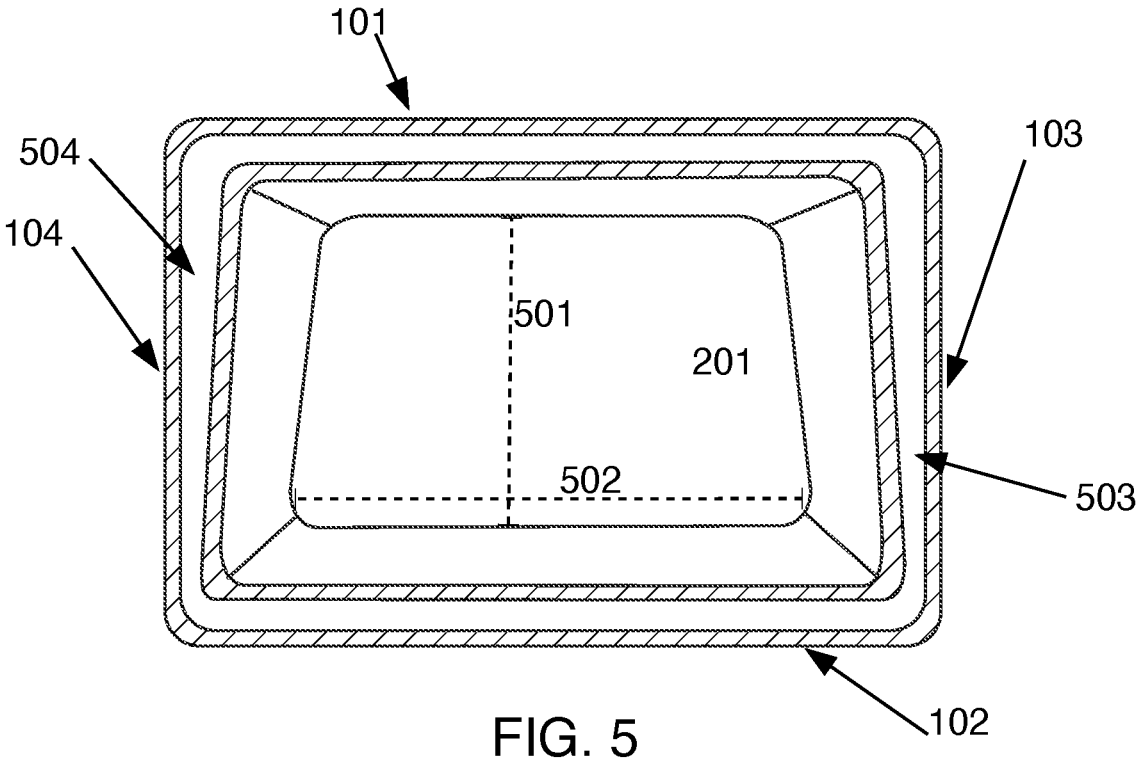
FIG. 5 is a section of the chest at a-a.
Figure 6:
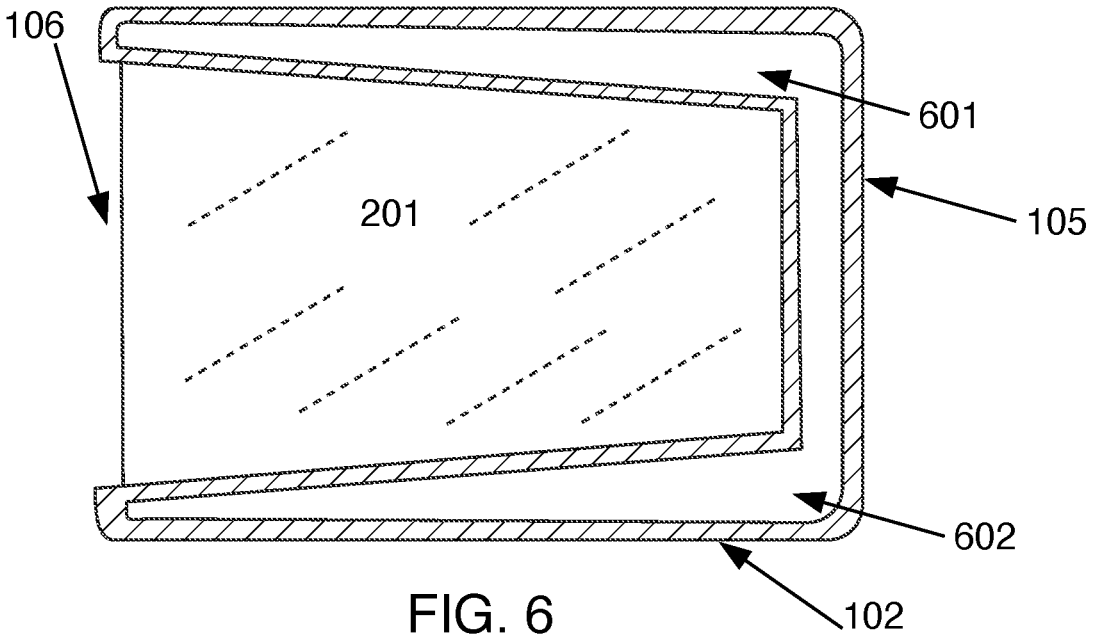
FIG. 6 is a section of the chest at b-b.

In the most highly preferred embodiment said front face comprises a removable lid, which when removed reveals the opening of the chest and exposes the inner compartment of the chest. In an alternative design said front face comprises a hinged door. This opening comprises a width (301) and a height (302). The inner surface of the inner wall of the back comprises a height (501) which is less than the height of the opening and at least one width (502) which is less than the width of the opening. The outer walls form a cube or cuboid shape, but the inner compartment of the chest is a 3D trapezoid with the two parallel sides of the trapezoid formed by the inner wall of the front face and the inner wall of the back face (see FIGS. 5 and 6). The cavity (601 between the inner and outer walls of the top and the cavity (602) between the inner and outer walls of the bottom each comprises a slanted width which is narrower near the front face (106) and wider near the back face (105). Similarly, the cavity (503) between the inner and outer walls of the first side and the cavity (504) between the inner and outer walls of the second side each comprises a slanted width which is narrower near the bottom face (102) and wider near the top face (101).

This slanted cavity structure causes the refrigerant gel to expand or solidify beginning at the narrowest point of a cavity and expand toward the widest point of a cavity, reducing the risk of a blockage forming and forcing refrigerant gel to expand against a wall of the chest. Rather, as the refrigerant gel expands or solidifies it is guided toward a more expansive space.

The refrigerant gel can be selected from several products such as e.g., one of the refrigerant gels noted in U.S. Pat. No. 5,148,804. The exact recipe and amount of refrigerant gel sealed within the cavities of a chest as disclosed here is variable and based on the target temperature to be maintained and the estimated duration of power interruption. For example, if a chest is used to just mitigate freezer burn due to power cycling, a smaller gel with a freezing point near that of water may be sufficient. Conversely, chests expected to maintain a cold internal temperature for power outages for several hours require a larger amount of a gel that freezes well below 0° C.

In use, the disclosed chest is placed into a freezer, and the refrigerant gel within the chest is allowed to equilibrate with the temperature of the freezer. As most home freezers are set to approximately −20° C., it will likely take several hours to cool the completely chill the refrigerant gel. A user opens the chest and food or other material is placed inside before the chest is again closed. The mere containment of food will increase the vapor pressure inside the chest reducing sublimation from the surface of the food. This coupled with the heat-absorbing refrigerant gel and the thermal insulation (R-values) of the walls of the faces of the chest will mitigate temperature change within the chest due to frost-free freezer cycling, even further reducing the incidence of freezer burn. Further, the chilled refrigerant gel and thermal insulation (R-values) of the walls of the faces of the chest will keep the temperature of the inner compartment of the chest stable over extended periods of power outage.

The subject matter of this application may be placed in an upright refrigerator, in which case the front face is likely nearest to the door of the freezer; but it may also be placed with the back face nearest the ground as it may be within a chest freezer. The design of the slanted cavities allows the refrigerant gel to expand without damaging the walls of the chest in either position.

The invention claimed is:

1. A chest comprising a top face, a bottom face, a first side face, a second side face, a back face, a front face and an inner compartment, a. said top face comprising an inner wall and an outer wall, i. said top face further comprising a cavity separating the inner wall and the outer wall, b. said bottom face comprising an inner wall and an outer wall, i. said bottom face further comprising a cavity separating the inner wall and the outer wall, c. said first side face comprising an inner wall and an outer wall, i. said first side face further comprising a cavity separating the inner wall and the outer wall, d. said second side face comprising an inner wall and an outer wall, i. said second side face further comprising a cavity separating the inner wall and the outer wall, e. said back face comprising an inner wall and an outer wall, i. said back face further comprising a cavity separating the inner wall and the outer wall, f. said outer wall of said top face and said outer wall of said bottom face are parallel with each other, g. said outer wall of said first side face and said outer wall of said second side face are parallel with each other, h. the cavities of the top face, bottom face, first side face, second side face and back face contain a refrigerant gel, i. said inner compartment is a three dimensional exclusive trapezoid comprised of two parallel planes formed by the front face and the back face.

2. A method for providing a temperature-stable region within a larger insulated space comprising the steps of opening the larger insulated space, placing the chest of claim 1 within said insulated space, placing foodstuffs or other items within the inner compartment of the chest, closing the chest, and closing the insulated space.

* * * * *